US005301818A

United States Patent [19]

Dix

[11] Patent Number: 5,301,818

[45] Date of Patent: Apr. 12, 1994

[54] SUPPORT RACK FOR A SKATEBOARD

[76] Inventor: Kevin M. Dix, 78-17 87th Ave., Woodhaven, N.Y. 11421

[21] Appl. No.: 60,306

[22] Filed: May 7, 1993

[51] Int. Cl.[5] ..... A47F 7/00

[52] U.S. Cl. ..... 211/13; 211/87

[58] Field of Search ..... 211/87, 66, 13, 70.6; 248/301, 303, 304, 250

[56] References Cited

U.S. PATENT DOCUMENTS

| | | | |
|---|---|---|---|
| 434,819 | 8/1890 | Beckmann | 211/87 X |
| 2,472,058 | 6/1949 | Artley | 211/13 |
| 4,735,325 | 4/1988 | Remmers | 248/250 X |
| 4,911,310 | 3/1990 | Raishe et al. | 211/87 |
| 5,071,012 | 12/1991 | Jailor | 211/70.6 |

OTHER PUBLICATIONS

Kevin Dix; "Support Rack for a Skateboard"; U.S. Ser. No. 29/008,112-co-pending U.S. design patent appln. filed May 7, 1993.

*Primary Examiner*—Alvin C. Chin-Shue
*Assistant Examiner*—Sarah A. Lechok

[57] ABSTRACT

There is provided a rack for supporting a skateboard by hanging the skateboard vertically by way of one pair of its wheels and allowing the board and remaining pair of wheels to hang below. The rack comprises a broad, flat plate mountable on a wall or other substantially vertical surface. A support shelf for a skateboard comprising two shelf parts, one for each of a pair of skateboard wheels, is located on the front face of the plate and extends outward from the plate. The support shelf has a horizontal supporting surface in the shape of the inside of a partial tube. The inside tube surface is generally cylindrical and conforms to the outer surface of the skateboard wheels. The partial tube has an arc of approximately 130° to 180° of a circle, measured from a point at which a vertical line tangentially intersects the surface, so that the wheels may be easily inserted from above, but such that the wheels can rest securely and be adequately supported by the supporting surface. The plate further comprises an integral lateral extension at its lower edge. The extension should extend downward and be shaped symmetrically about the vertical center of balance of the plate. The extension should rest against the wall to stabilize the rack and counter the rotational force exerted by a hanging skateboard.

5 Claims, 1 Drawing Sheet

SUPPORT RACK FOR A SKATEBOARD

BACKGROUND OF THE INVENTION

This invention relates to a support rack for a skateboard or other similar wheeled device. More particularly, this invention relates to a wall-mountable rack for suspending a skateboard by one set of wheels thereof.

The increased popularity of skateboards has created a need for proper storage or display means. As i#stands, skateboards present a danger in the home or public place when left unattended on the floor, or are simply left leaning against a wall when not in use. Current methods of displaying skateboards for sale in stores include laying the skateboard on edge on a shelf, or suspending the skateboard on a hook by way of the wheel truck. All of these attempts at supporting the skateboard are inadequate due to the inherent instability of a skateboard, i.e. a broad flat irregular shaped board having two sets of wheels attached underneath. These current methods result in either the skateboard tipping over to expose the wheels, or to expose the top surface of the board rollable on the wheels. When a skateboard is suspended by way of its wheel truck, the board has a tendency to swing about the suspending means due to the usually cylindrical shape of the truck.

Furthermore, current sales display racks for skateboards are often simply shelves or pegboard hooks, with the skateboards displayed in a whatever direction results. Since a major factor in choosing to buy a skateboard is not only the function, but how it looks to the buyer, these unappealing display means may detract from the visual effect desired by the seller.

It is therefore an object of the present invention to provide a support rack for a skateboard which can safely support and display a skateboard in a stable position.

It is a further object of the present invention to provide a support rack which is especially adapted to support and display a skateboard in a visually advantageous manner.

It is a still further object of the present invention to provide a support rack which can be made economically and consists of a single piece.

SUMMARY OF THE INVENTION

Accordingly, there is provided a rack for supporting a skateboard by hanging the skateboard vertically by way of one pair of its wheels and allowing the board and remaining pair of wheels to hang below. The rack comprises a broad, flat plate mountable on a wall or other substantially vertical surface. A support shelf for a skateboard is located on the front face of the plate and extends outward from the plate as two separate shelf parts, each for accommodating one of a pair of wheels. A space is left between the two shelf parts to accommodate the wheel truck connecting the two wheels to each other and to the bottom of the skateboard. The support shelf has a horizontal supporting surface in the shape of the inside of a partial tube. The inside tube surface is generally cylindrical and conforms to the outer surface of the skateboard wheels. The partial tube is between 130° to 180° of a circle, as measured from a vertical line tangentially intersecting the surface arc, so that the wheels may be easily inserted from above, but such that the wheels can rest securely and be adequately supported by the supporting surface. The plate further comprises an integral lateral extension at its lower edge.

The extension should extend downward and be shaped symmetrically about the vertical center of balance of the plate. The extension should rest against the wall to stabilize the rack and counter the rotational force exerted by hanging skateboard.

DETAILED DESCRIPTION OF THE INVENTION

Figure 1:
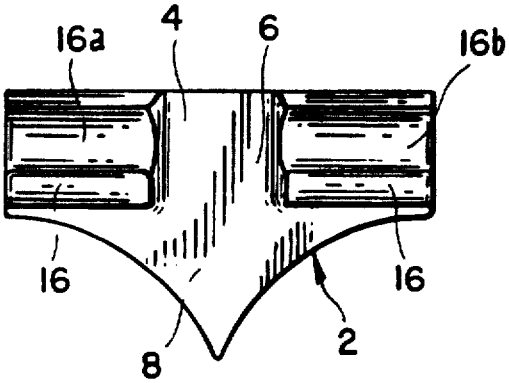
FIG. 1 is a front view of one embodiment of the support rack of the invention.

The support rack 2 comprises a broad, flat plate 4 having a main portion 6 and a lateral extension 8. The plate 4 has a back face 10 which is adapted to allow the plate to rest flat against a wall or supporting surface 12 to which it is mounted. Thus, the back face can be uniformly flat throughout, or have supporting extensions of uniform height with the remainder of the face hollowed out to reduce material usage. The plate 4 should be of a thickness 14 to provide sufficient strength against the rotational force exerted by a skateboard hanging in the rack. The outline of the plate 4 may be of any shape, but should be broad enough to provide stability with respect to the wall as against rotational forces in directions towards the wall. Thus, in the embodiment shown in FIG. 1, the plate is sufficiently broad in the side-to-side direction provide stability against rotation about the vertical axis of the plate.

Figure 3:
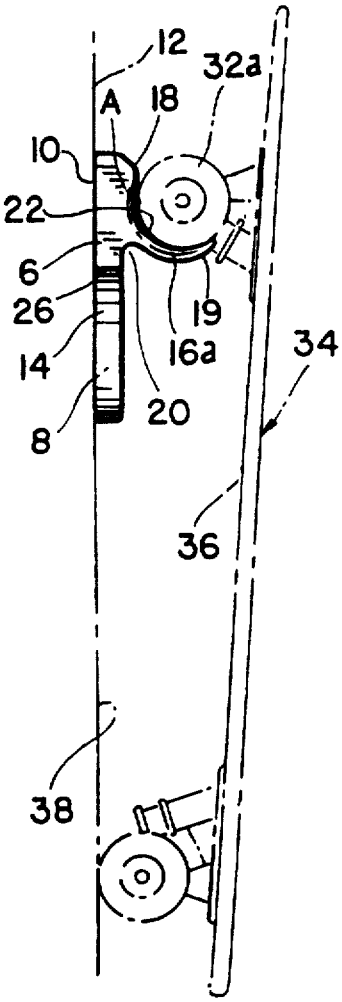
FIG. 3 is a side view of the support rack embodiment of FIG. 1 attached to a wall surface and having a skateboard suspended from the rack.
Figure 4:
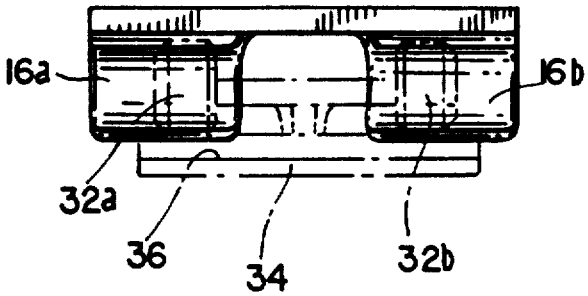
FIG. 4 is a top view of the support rack embodiment of FIG. 1 having a skateboard suspended from the rack.

A support shelf 16 for accommodating a pair of wheels of a skateboard to thereby support the skateboard hanging therefrom extends outward from the front face 18 of the plate 4. The support shelf consists of two separate shelf pieces 16*a*, 16*b*, located symmetrically about the vertical central axis of the plate. The shelf pieces 16*a*, 16*b* each support one of a pair of wheels 32*a*, 32*b* of a skateboard 34, as shown in FIG. 4. The support shelf 16 should preferably be integral with the plate 4 to provide maximum strength and ease of manufacture. The outer portion 19 of the support shelf 16 may be of any convenient formation, but may not interfere with the underside 36 of the skateboard. Similarly, the region 20 where the support shelf 16 connects to the plate 4 may be of any shape, so long as it provides sufficient strength to the connection between the support shelf and the plate to resist the downward force of a hanging skateboard. As shown in FIG. 3, the outer portion 19 has a shape which generally follows the shape of the support surface 22. It should be understood that any shape of the outer portion 19 may be used so long as provides sufficient support for a skateboard hanging from the support shelf.

The support shelf 16 has a support surface 22 for receiving and supporting a pair of wheels 32*a*, 32*b* of a skateboard. The support surface 22 should be generally horizontal and is shaped to conformingly retain a pair of cylindrical skateboard wheels. Accordingly, the support surface 22 is formed in the shape of the inside of partial cylindrical, horizontal tube, open at the top so that the skateboard wheels can be inserted onto the surface 22 from above and so that, once inserted, the wheels are securely retained within the tube. To allow for insertion of the wheels from above, the partial tube of the surface 22 must have a total arc of less than 180°. Furthermore, in order to insure that the wheels are securely retained within the tube surface and can not be easily move forward away from the plate, the partial tube of the surface 22 should have an arc of at least 130°, and preferably at least 140°, measured from the point A of a vertical line tangentially intersecting the arc of the tube surface. In the embodiment shown in the figures, the arc measured from point A is approximately 140°, while the total arc of the surface 22, including that portion above point A, is approximately 160°.

Figure 2:
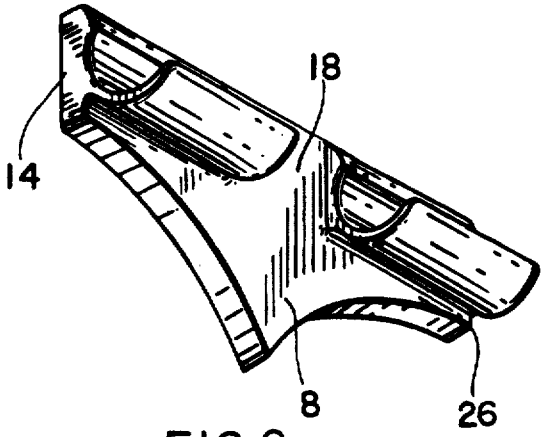
FIG. 2 is a perspective view of the support rack embodiment of FIG. 1.

As shown in FIGS. 1 and 2, the plate 4 further comprises an extension 8, integral with the plate 4 and extending downward from the main portion 6. As seen with reference to FIG. 3, the extension 8 functions to provide stability to the support rack by acting against the supporting wall 38 to resist the rotational force exerted about the horizontal axis in a plane parallel to the plate located at the center of gravity of the support rack supporting a skateboard thereon. Therefore, the extension 8 should extend to a point below the main portion 6 of the plate 4 so as to provide sufficient stability. Those skilled in the art will determine the required length of the extension by taking into account the thickness and inherent material strength of the plate, and hence the plate extension, as well as the size and weight of the skateboard to be supported by the rack.

In order to reduce the cost of production due to unnecessary use of extra material, the extension may be fashioned to use a minimum of material, while still extending to its required length. The extension 8 is characterized by a reduced width starting from the location where the extension 8 meets the bottom edge 26 of the main portion 6. The perimeter of the extension 8 may be in any desirable shape, taking into account the need to provide sufficient strength, while using as little material as possible. In other words, the extension should preferably be of such a shape as to have minimal surface area while performing its function of resisting rotational movement. Furthermore, regardless of the chosen shape of the extension, it should preferably be symmetrical about the central vertical axis thereof to provide stability. In a preferred embodiment, the lateral extension 8 has a width which continually decreases from the point 26 at which the extension meets the main portion of the plate, down to the lower end of the extension.

As described above, the support rack of the invention is preferably made from a single piece of strong material, to provide maximum strength while reducing costs of manufacture. One advantageous method of manufacture would be by injection molding of plastic. The support rack can be mounted to a wall or other surface by any known mounting means.

While certain preferred embodiments of the supporting rack of the invention have been described herein, it is to be understood that the invention is not limited to these precise embodiments and that changes may be made to the invention without departing from the scope thereof as defined in claims.

What is claimed is:

1. A wall-mountable rack for supporting a skateboard, the rack comprising a plate, the plate comprising a main upper portion and an integral lateral extension below the main portion, the plate having a back face and a front face, the back face being adapted to rest flat against a wall or horizontal flat surface, the front face of the plate having extending outwardly from the main portion an integral support shelf for supporting a skateboard by way of a pair of wheels thereof, the support shelf comprising two shelf parts located symmetrically about a central vertical axis of the plate, the shelf parts having a space therebetween for accommodating a wheel truck of the pair of skateboard wheels, the support shelf having a horizontal upper support surface in the shape of a partial inside tubular surface for conformingly retaining a pair of cylindrical skateboard wheels, the tubular surface having a total arc of less than 180° an arc as measured from a point on a vertical line tangentially intersecting the tubular surface of at least 130°, the lateral extension extending from below the main portion of the plate so as to resist a rotational force about a horizontal axis in a plane parallel to the plate, the lateral extension having a reduced width compared to the main portion, and the plate being substantially symmetrical about a vertical central axis thereof.

2. The rack of claim 1, wherein the lateral extension has a width which continually decreases from the point where said extension meets the main portion of the plate to a bottom of the extension.

3. The rack of claim 1, wherein the arc of the tubular surface of the support surface measured from said tangent point is at least 140°.

4. The rack of claim 1, wherein the lateral extension has the least possible lateral area able to resist said rotational force about said horizontal axis.

5. The rack of claim 1, wherein the rack consists of a single piece.

* * * * *